United States Patent [19]

Wright

[11] Patent Number: 4,471,981

[45] Date of Patent: Sep. 18, 1984

[54] PERSONAL SECURITY LOCK

[76] Inventor: Thomas E. Wright, 398 Cedar Ridge LBS, Barrington, Ill. 60010

[21] Appl. No.: 342,714

[22] Filed: Jan. 25, 1982

[51] Int. Cl.[3] ..... E05C 19/18

[52] U.S. Cl. ..... 292/292; 292/295

[58] Field of Search ..... 292/292, 289, 290, 293–296, 292/258; 70/14, 19

[56] References Cited

U.S. PATENT DOCUMENTS

| | | | |
|---|---|---|---|
| 793,098 | 6/1905 | Rohrer | 292/292 |
| 866,548 | 9/1907 | Wilkinson | 292/292 |
| 1,166,692 | 1/1916 | Kennedy | 292/292 |
| 1,339,856 | 5/1920 | Moore | 292/296 |
| 1,412,340 | 4/1922 | Cruikshank | 292/292 |
| 1,467,057 | 9/1923 | Moglich | 292/292 X |
| 3,161,428 | 12/1964 | Zook | 292/292 |
| 3,352,587 | 11/1967 | Harvey | 292/289 |
| 3,416,333 | 12/1968 | Weingart | 292/292 X |

*Primary Examiner*—Gary L. Smith
*Assistant Examiner*—R. Illich

[57] ABSTRACT

A security lock for attachment to the inside of a door which is secure, pick-proof, adaptable to any door-lock and door-frame combination and is easily locked and unlocked by the user. The lock is characterized by having a hook end to engage the striker plate depression and a slideable lock piece that engages the shank of the lock at adjustable positions to lock upon its serrated or toothed edge against the door and frame at their juncture and thus prevent the door from being swung inwardly.

4 Claims, 11 Drawing Figures

PERSONAL SECURITY LOCK

BACKGROUND OF THE INVENTION

There are a number of personal security locks on the market or known to the prior art. Some of these locks require a key and are thus continuously subject to the hazard of loss of the key. Other such locks are quite complicated. One form of lock has a flat shank portion of rather thin weak metal with a right-angle hook end to engage the striker plate and a spring-clamp to engage toothed edges along the shank. This construction is not strong enough to resist an intruder. Also this type of lock can be dislodged by use of a long thin-nosed pliers, available to burglars, which can be used to squeeze the spring-clamp to the open position.

Another form of door lock is shown in U.S. Pat. No. 3,352,587 by R. M. HARVEY using a hook member with a series of bore holes therealong into which a pin is engaged. The pin in turn is engageable with a pair of blocks, one at each end. The holes in the blocks are off-center so that the blocks can be rotated into abutting positions against the frame and door. This is a four-piece arrangement. Rattling the door can work the blocks off the pins and allow the lock to open.

THE INVENTION

This invention is an improvement over the prior art locks in that the hook end of the shank has an enlarged plate to cover the depression in the frame under the strike plate to prevent tampering by insertion of a sharp strong instrument. Also the locking piece is designed to be moved transverse the longitudinal axis of the shank portion to engage and lock with selected serrations along the edges of the shank member, top and bottom to provide additional insurance against dislodgement. The locking piece engages the shank portion interchangeably and has off-set foot members or projections that engage the door and door frame, whereby the lock is useable with all types of door and frame combinations, irrespective of any off-sets in their vertical planes when the door is in the closed position.

These and other aspects of the invention will be described or become apparent as the specification proceeds and also by reference to the drawings wherein.

DESCRIPTION OF THE INVENTION

Specific and illustrative embodiments of the invention will now be described.

Figure 1:
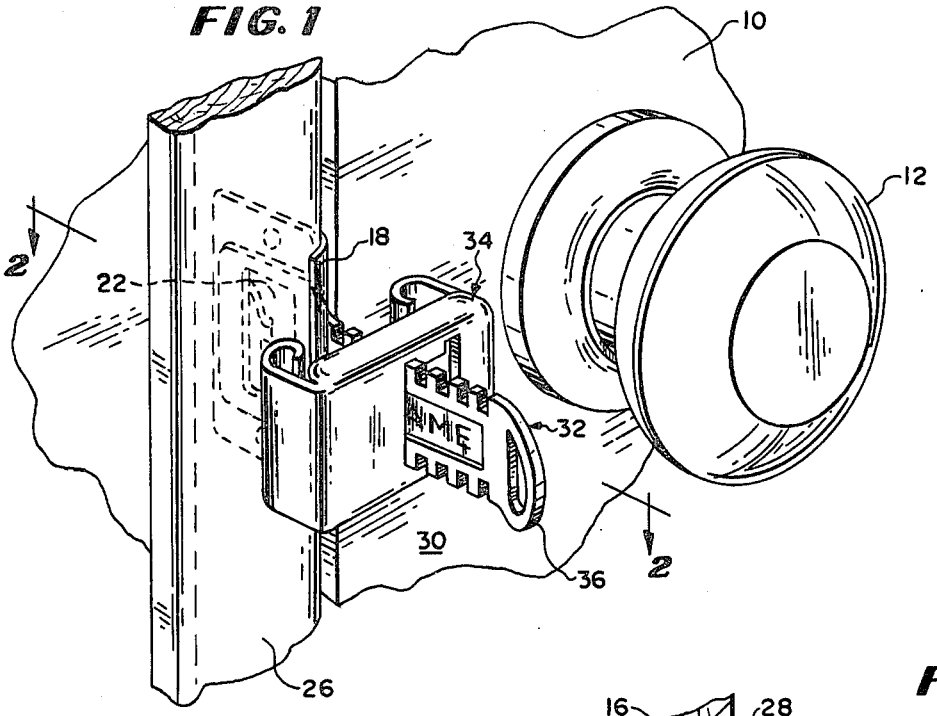
FIG. 1 is a fragmentary perspective view of a door and frame with the lock of this invention attached in locked position at the inside thereof.
Figure 2:
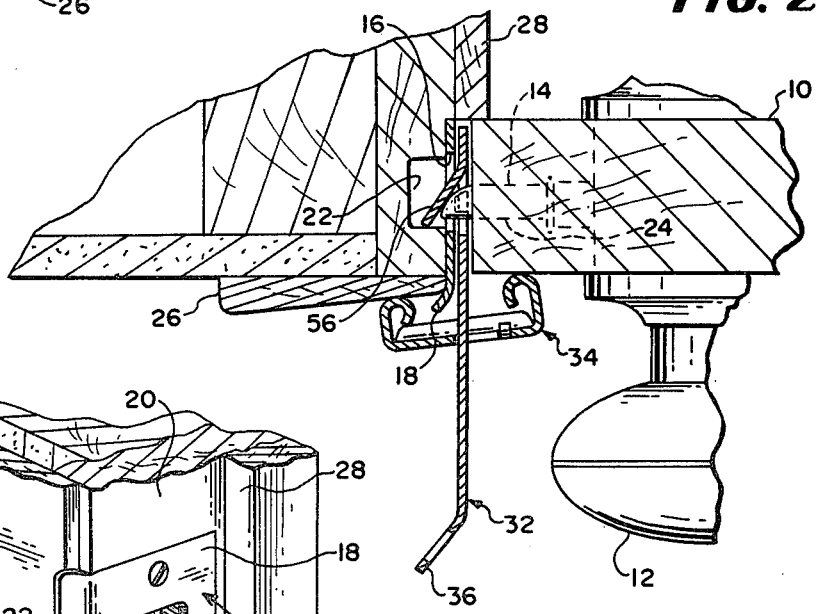
FIG. 2 is a cross-sectional view taken along the lines 2—2 of FIG. 1.
Figure 3:
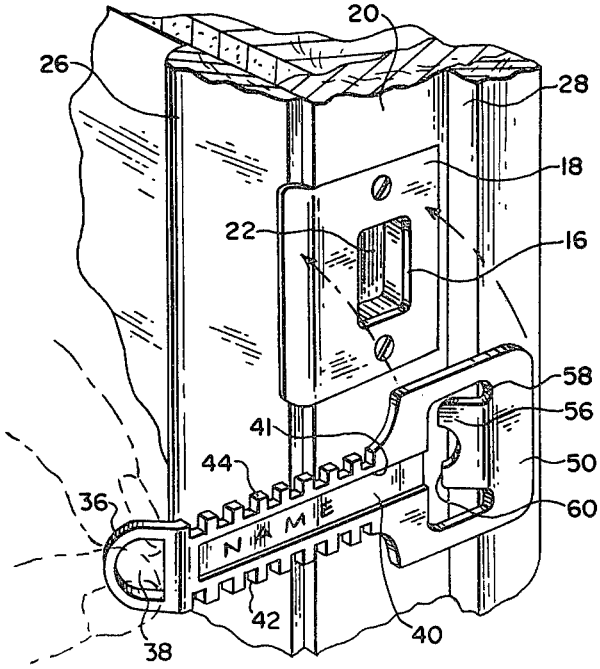
FIG. 3 is a fragmentary view of a door frame, like FIG. 1, to expose the striker plate with the hand-held flat hook member shown in perspective and in a position to be inserted into the depression of the striker plate.

Referring to the drawings, a door 10 is illustrated with the known form of door knob 12, having a reciprocatable bolt 14 (FIG. 2) engageable within the opening 16, of the metal striker plate 18, affixed to the door frame 20. The opening 16, forms a reinforcement for the depression or recess 22 cut into the wooden door frame. The bolt 14, has a relatively flat surface 24 (FIG. 4) which engages against or is engageable against the inner edge of the striker plate opening 16, to keep the door closed. The door frame 20 generally includes a trim piece 26 and depending on its thickness, the manner in which the door fits, etc. is generally not in the same plane as the door. The door jamb 28 is shown in FIGS. 2 and 3.

The striker plate and door latch mechanism are known parts and are generally made of metal. The door, door frame, trim and door jamb can be made of any suitable material, and are generally made of wood or metal.

The door lock assembly 30 of this invention includes the locking bar or locking hook 32 and the lock piece or fastener 34.

Figure 5:
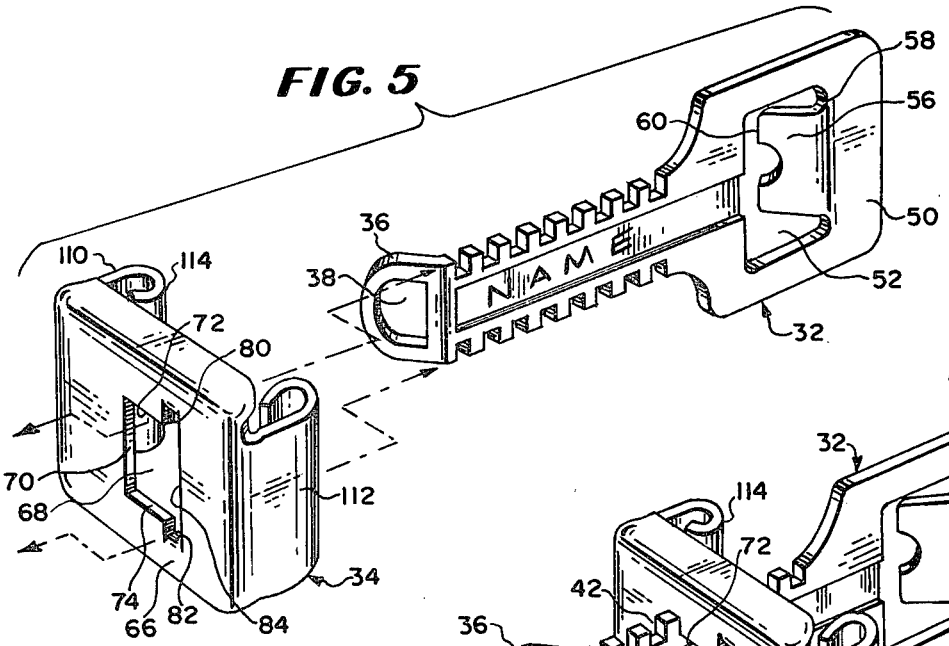
FIG. 5 is an exploded view of the two parts of this invention, the hook member and the lock piece in positions to show the interrelation of their locking parts.

Referring briefly to FIG. 5 the assembly 30 as shown in greater detail wherein the locking bar or hook 32 is shown as an elongated strong, flat metal piece with its off-set end 36 having an opening 38 to provide a finger grip.

The shank portion 40 is flat and has an elongated flat groove 41 to contain a printed message or advertising and protect it from scratches. The advertising may appear on both sides.

The shank portion 40 has the series of square notches 42 defining the square teeth 44 therebetween on both of its edges. The notches are the same depth and width and spacing so that the teeth 44 are even and the same size. The notches 42 and teeth 44 are aligned one to the other on the edges of the shank. The shank portion 40 widens into the safety plate member 50, having the opening 52 and the integral off-set tab 56 extending from the end edge 58 of the opening 52.

The tab 56 has the pair of spaced flat teeth 60 at its extended end edge. These teeth may be pointed and form means for engaging into the wood of the recess 22 of the door frame 20. The end 36 of the hook 32 and the tab 56 are bent to the same side of the locking bar 32. This facilitates holding the locking hook 32 in position as the door is opened or closed thereon.

Figure 11:
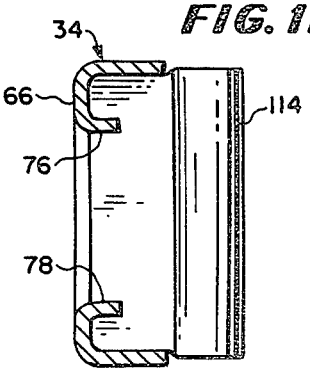
FIG. 11 is a cross-sectional view taken along lines 11—11 of FIG. 8.

FIG. 5 also shows the details of the locking piece 34 to include the flat body 66 defining the opening 68 bordered by the edge 70 and the top and bottom edges 72 and 74, with the end portion between the turned down tabs 76 and 78 (See FIG. 11) forming the notches 80 and 82 contiguous to the side edge 84.

The space or opening 68 is adapted for two functions. The opposed open-ended notches 80 and 82 are aligned and define an opening that evelopes the shank 40 of the locking bar or hook 32. The notches provide clearance for the teeth 44 and the tabs 76 and 78 provide a smooth surface along which the teeth slide and do not catch. The tabs 76 and 78 effectively widen the walls of the opening 68 so that they do not allow these walls to engage into the notches 42.

The second function of the opening 68 is to receive the shank 40 upon the sideways movement of the lock piece 34 in relation to the shank 40 and lock the assembly in the locked position. The edges 72 and 74 of the opening 68 engage within the top and bottom opposed slots or notches 42 of the shank 40. The slots 42 are slightly wider than the thickness of the metal used to fabricate the lock piece 34.

The teeth 44 can be any width, though it is obvious that more notches and finer adjustment of the lock can be provided if this part is fabricated with rather narrow widths without detracting from their strength. It is not necessary that the teeth and notches be aligned exactly at the top and bottom edges. Also the notches engage the edges 72 and 74 with sufficient play that the lock piece 34 can hinge slightly as will be described.

Figure 7:
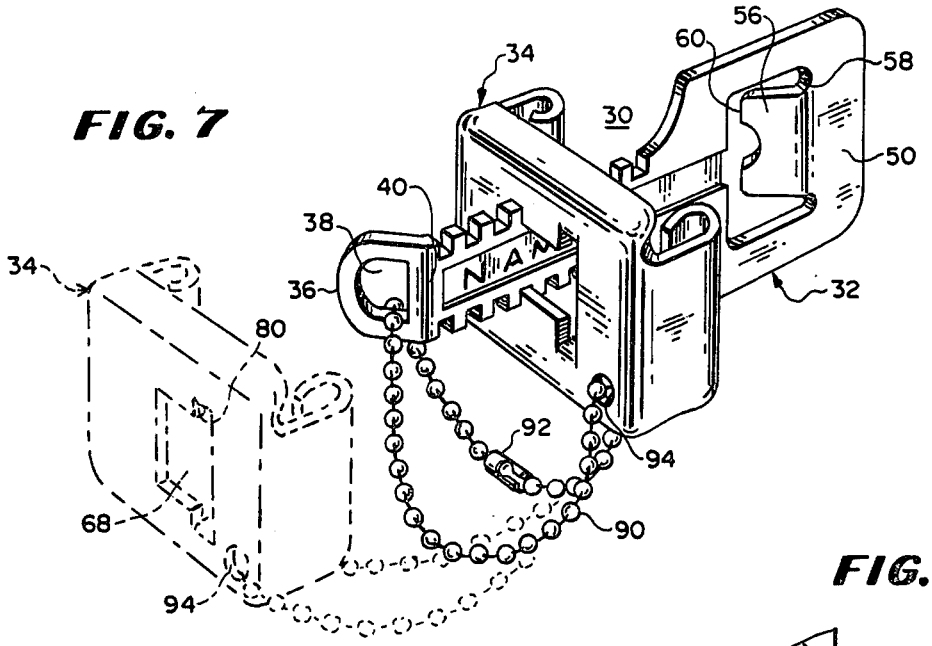
FIG. 7 is a perpective view of the parts of this invention as shown in FIG. 6 with a chain tether linking the parts together.

According to FIG. 7 the lock assembly 30 includes a detachable chain 90 with a releaseable fastener 92 attached through the hole 38 in the shank 40 of the locking bar 32 and also attached through the hole 94 of the locking piece 34. The phantom portion of the drawing illustrates the release position of the locking piece 34.

Figure 10:
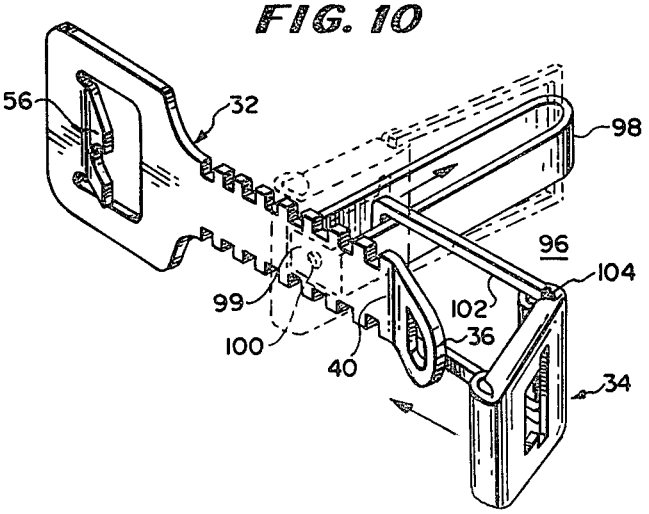
FIG. 10 is a perspective view, partly in phantom showing a modified form of the invention.

FIG. 10 illustrates another type of tether means 96 to include the flat U-shaped yoke 98 attached through its end plate 99 by means of the rivet 100 to the flat shank 40 of the locking bar 32. The locking piece 34 carries the pivotal U-shaped tether 102 which extends through and connects with the yoke 98 and has its ends riveted to the locking piece 34 as indicated by the rivet 104. A similar pivot point is provided at the bottom corner of the locking piece 34.

The locking piece 34 has a pair of legs or feet 110 and 112 each having a rounded end 114. The leg 112 is longer than leg 110 in FIG. 5 and the opposed slots 80 and 82 are in a side nearest the longer foot means. These constrictions allow accomodation of the locking device to all forms of door and trim combinations irrespective of the planar or non-planar relationship of the door and the door frame or trim in the closed position of the door.

Figure 8:
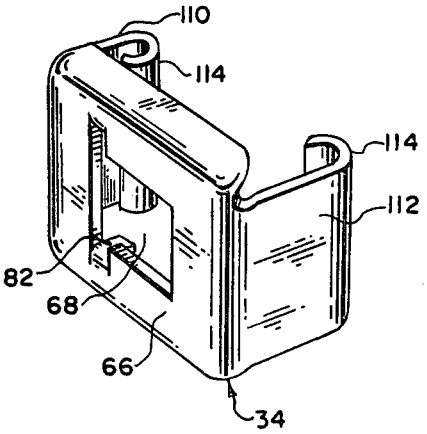
FIG. 8 is a perspective view of a modified form of lock piece.

In FIG. 8, the opposed slots 80 and 82 are on a side of the locking piece 34 nearest the shorter leg or foot.

Figure 6:
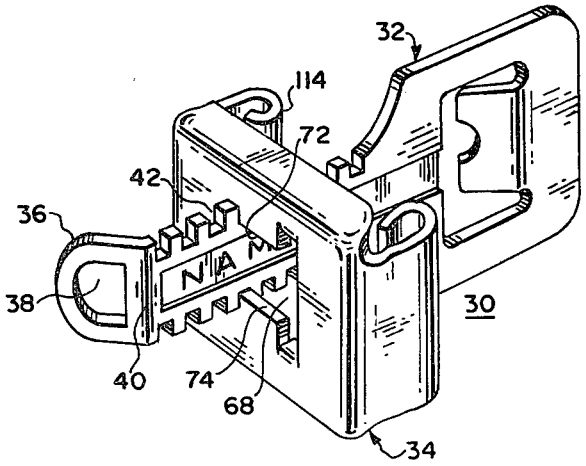
FIG. 6 is a perspective view of the parts in their locked position.

FIG. 6 shows the locked position of the lock of this invention without the door or door frame parts to interfere with the perception of how the parts engage one another. Here it is seen that the locking piece 34 has been moved to the right as viewed in FIG. 6, so that the edges 72 and 74 of the opening 68 pass into a pair of opposed notches 42 in the shank 40. In this position the locking piece can hinge a little and effectively engage the door and door trim. The rounded feet 114 prevent marring of the wood.

Figure 4:
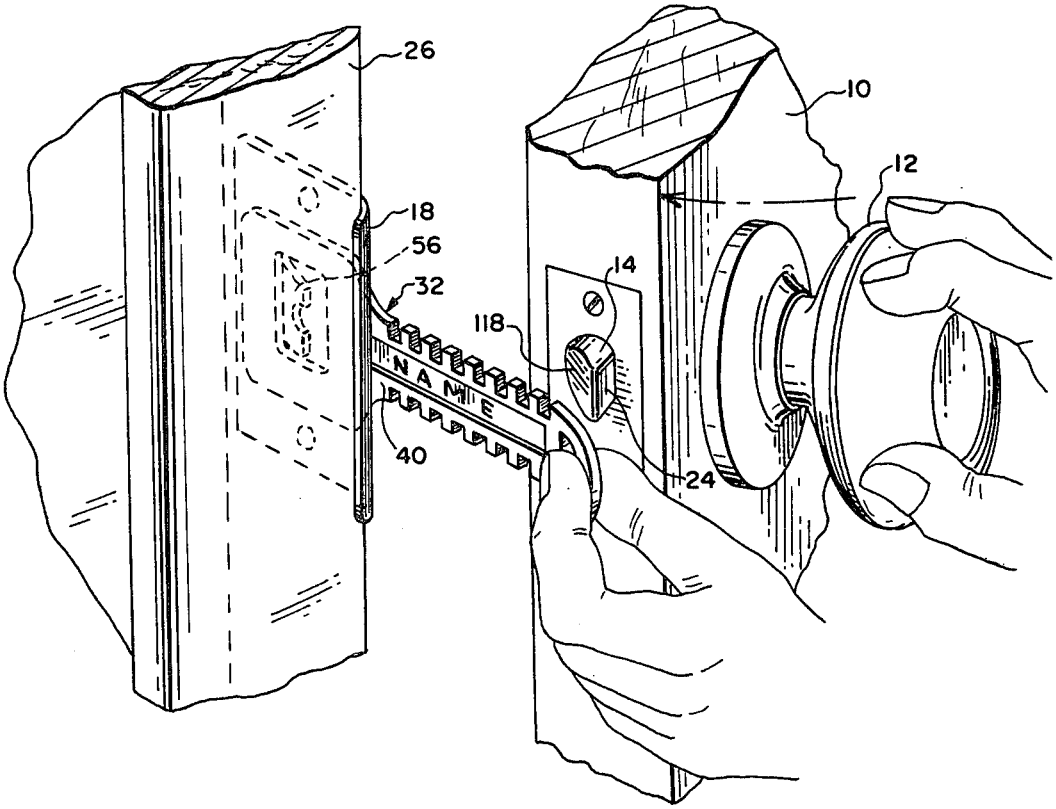
FIG. 4 is a view like FIGS. 1 and 3 with the hook member in place within and against the striker plate and the door about to be closed thereon.

FIG. 4 illustrates how the hook means 32 is held in place with the tab member 56 positioned in the lock plate opening of the striker plate 18. The door 10 is then closed and the bolt 14 with its bevelled end 118, slides against the shank 40 and the bolt snaps into locked position against the tab member 56 as shown in FIG. 2. The tab member 56 does not interfere with the locking action of the bolt 14.

Next the locking piece 34 is placed over the end 36 and as it is pushed toward the door 10, the shank 40 slides down the opposed notches 80–82, aided by the ramps 76 and 78 which prevent the teeth from catching. With the locking piece 34 against the trim and door, it is moved sideways at the nearest exposed and available notches to the position shown in FIGS. 1, 2, 6 and 9 i.e. the locked position.

The plate 50 prevents access to the bolt 14 by an intruder. The tab member 56 engages within recess 22 and the locking piece 34 engages against both the door and frame or trim so that the door cannot be pushed open when outside even if the latch 14 is depressed or unlocked.

Figure 9:
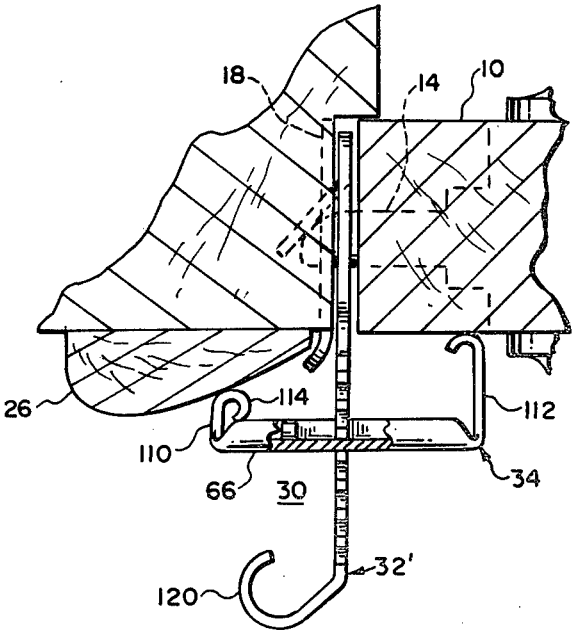
FIG. 9 is a fragmentary cross-sectional view of the modified form of the lock piece shown in FIG. 8, in locked position on a door with an off-set frame.

Referring to FIG. 9 the hook means or lock bar 32' has been modified to include the enlarged bent end 120 which is larger than the opening 68 in the locking piece 34, thus effectively keeping the two pieces together. The end 120 is formed after the parts are put together. The hole 68 can be large enough to allow 180° or 360° rotation of the locking bar 32' and the locking piece 34 in relation to each other so that the locking piece will not interfere with the step of attaching the locking bar to the striker plate, as shown in FIG. 4.

The specification has included several embodiments of the invention and it is understood that these are for purposes of illustration and not to be taken as a definition of the scope of the invention, which definition may be had by reference to the claims.

I claim:

1. A security lock comprising the combination of:

an elongated flat member having a plate at one end with a central opening, an off-set hook member extending through said central opening at an oblique angle from the end of said (plate) flat member, a shank member at the other end of said flat member defining parallel opposite edges therealong, a series of opposed square-cut teeth along said opposite edges, a lock piece having an opening to receive said shank member, said opening in said lock piece having an elongated portion defined by slots whereby to receive the opposed square-cut teeth of said shank member, the ends of said slots having flat ramps longer than the width of the square cuts in said edges to allow said shank member to pass therethrough without catching, said opening in said lock piece having a smaller portion of a width less than the distance between said parallel opposite edges whereby the edges thereof pass into said cuts and hold said lock piece in locked position on said shank member upon transverse movement of said lock piece on the axis of said shank member, and said lock piece includes a pair of longitudinally-spaced projections extending from one side to engage against a said door and its frame respectively in a biased position holding said door closed.

2. A security lock in accordance with claim 1 in which said one end of said flat member is enlarged to cover a depression of a striker plate, an opening in the enlargement of said flat member, said off-set hook member is an extension of an edge of said opening in said flat member, and includes a toothed edge to engage within said depression.

3. A security lock in accordance with claim 1 in which said longitudinally spaced projections are of different heights whereby to accomodate any offset in the plane of said door and its frame in the closed position.

4. A security lock in accordance with claim 1 wherein;

said smaller portion of said opening in said lock piece has an effective area large enough to allow said lock piece to be rotated therein at least 180° and reverse the locked position of said lock piece.

* * * * *